US006957495B1

(12) United States Patent
Schmillen

(10) Patent No.: US 6,957,495 B1
(45) Date of Patent: Oct. 25, 2005

(54) SPRING LOCK SPRING LINE CHALK BOX

(76) Inventor: Luke Schmillen, 1505 W. Columbia Ter., Peoria, IL (US) 61606

( * ) Notice: Subject to any disclaimer, the term of this patent is extended or adjusted under 35 U.S.C. 154(b) by 0 days.

(21) Appl. No.: 10/845,291

(22) Filed: May 13, 2004

Related U.S. Application Data

(60) Provisional application No. 60/470,124, filed on May 13, 2003.

(51) Int. Cl.[7] ..... B44D 3/38
(52) U.S. Cl. ..... 33/414; 33/413
(58) Field of Search ..... 33/313, 314; 242/381.3, 242/385.4

(56) References Cited

U.S. PATENT DOCUMENTS

| | | | | | |
|---|---|---|---|---|---|
| 833,920 | A * | 10/1906 | Crawford | 33/414 |
| 3,438,595 | A * | 4/1969 | West et al. | 242/394 |
| 4,192,078 | A * | 3/1980 | Lore et al. | 33/414 |
| 4,197,656 | A | 4/1980 | Lane et al. | 33/414 |
| 4,592,148 | A * | 6/1986 | Longenette | 33/414 |
| 4,660,291 | A * | 4/1987 | Dehn | 33/414 |
| 4,765,557 | A * | 8/1988 | Kahmann | 242/381.6 |
| 4,924,597 | A * | 5/1990 | Tursi | 33/758 |
| 5,042,159 | A * | 8/1991 | Millen | 33/414 |
| 5,063,681 | A * | 11/1991 | Bradley | 33/414 |
| 5,465,494 | A | 11/1995 | Johnston | 33/414 |
| 5,493,787 | A | 2/1996 | Owens | 33/414 |
| 5,509,616 | A | 4/1996 | Millen, Jr. et al. | 242/381.5 |
| 5,644,852 | A | 7/1997 | Fuller et al. | 33/414 |
| 5,727,324 | A | 3/1998 | Moore | 33/414 |
| 5,822,874 | A | 10/1998 | Nemes | 33/414 |
| 5,920,997 | A * | 7/1999 | Girtman | 33/414 |
| 6,079,112 | A | 6/2000 | Love | 33/414 |
| 6,098,299 | A * | 8/2000 | Collins et al. | 33/414 |
| 6,289,597 | B1 * | 9/2001 | Beyers | 33/414 |
| 6,345,448 | B1 | 2/2002 | Chontos | 33/414 |
| 6,595,451 | B1 * | 7/2003 | Kang et al. | 242/381.2 |
| 6,826,845 | B2 * | 12/2004 | Pritchard | 33/414 |

* cited by examiner

*Primary Examiner*—R. Alexander Smith
(74) *Attorney, Agent, or Firm*—Husch & Eppenberger, LLC; David A. Chambers

(57) ABSTRACT

An automatically retracting chalk line dispenser having a first and second casing elements, chalk line, reel, coil spring, and thumb-lever. The thumb-lever operates as a brake thereby allowing for either controlled retraction or an effective lock on the chalk line.

33 Claims, 5 Drawing Sheets

SPRING LOCK SPRING LINE CHALK BOX

CROSS-REFERENCE TO RELATED APPLICATIONS

This application claims priority from U.S. Provisional Patent Application No. 60/470,124 filed May 13, 2003.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention relates generally to carpentry tools and more particularly to an automatically retracting chalk line dispenser for conveniently dispensing and retracting a chalked string, such as those commonly used by carpenters to form straight lines.

2. Related Art

Chalk lines are used by carpenters and other building tradesmen to mark straight lines between two end points on a work surface. A line is "drawn" by stretching a chalk-covered string over the work surface between the two designated end points and snapping the string to release the chalk. The chalk line designates a straight line from one end point to the other, since the string that makes the line is stretched tightly between the two end points.

Contemporary chalk line dispensers typically comprise a housing in which a quantity of chalk dust may be disposed and inside of which a spool of string is pivotally mounted such that the string may be extended from the housing while carrying thereupon a small amount of chalk dust. The string is extended such that it coincides with a line for which marking is desired. The string is then held stationary at both ends and plucked near the middle such that chalk dust is shaken from the string when the string impacts the surface to be marked, thereby forming a straight line between the two ends of the string. A line catch or hook may be utilized to anchor the string at the distal terminus of the line to be formed while the chalk line device is held stationary at the lines proximal the terminus by the user. The string is typically manually retracted into the device via a rotatable handle and winding mechanism. The disadvantages with this type of device is the time, effort, and physical ability required to retract the string.

U.S. Pat. No. 4,197,656 to Lane et al. discloses an automatically retracting chalk line dispenser having a drive casing, a reel casing, and a thumb-operated lever for releasing a clutch to enable spring reeling of the line. Lane does not disclose a thumb-operated lever which acts as both a clutch and a brake, nor does Lane disclose an eyelet for securing the chalk line dispenser.

U.S. Pat. No. 5,509,616 to Millen, Jr. et al. discloses an automatically retracting chalk line dispenser including a casing forming a chalk reservoir, a spool assembly, and an automatic centrifugal speed regulator assembly. Millen discloses a complex and expensive device for regulating the speed of the chalk line rewinding. Millen does not disclose an inexpensive and reliable device for regulating chalk line rewind speed.

U.S. Pat. No. 5,727,324 to Moore discloses a manually retractable chalk line dispenser having a tearddrop-shaped main body. Moore does not disclose automatic retraction of the chalk line nor a simple device for locking extended chalk line. Also, Moore does not disclose an eyelet for securing the chalk line dispenser.

There remains a need in the art for an automatically retracting chalk line dispenser having structure to simplify its use and effective chalk line control mechanisms for increased functionality.

SUMMARY OF THE INVENTION

It is in view of the above problems that the present invention was developed. The invention is an automatically retracting chalk line dispenser having a main body, a chalk line, and a thumb-operated spring lever that pinches the chalk line against the main body. The thumb-operated lever is constructed and arranged to act as both a clutch and a brake. With the chalk line extended, the thumb-operated lever may be partially depressed, thus allowing the chalk line to slowly be retracted by a spring connected to the reel. Alternatively, the thumb-operated lever is fully depressed thereby allowing the chalk line to be retracted at full speed. When the thumb-lever is not depressed, the thumb-lever pinches the chalk line against the main body effectively braking the chalk line.

In another aspect of the invention there is provided an eyelet attached to the main body for securing the chalk line dispenser to another article or object. For example, a penny nail is used to secure the chalk line dispenser to a wooden floor. The chalk line dispenser may be secured for one-hand operation.

In another aspect of the invention there is provided an alternative structure for clutching and braking the chalk line. This structure includes a combination of a screw tensioner that selectively tensions the chalk line to control its rewind and a stop button to effectively brake the chalk line.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
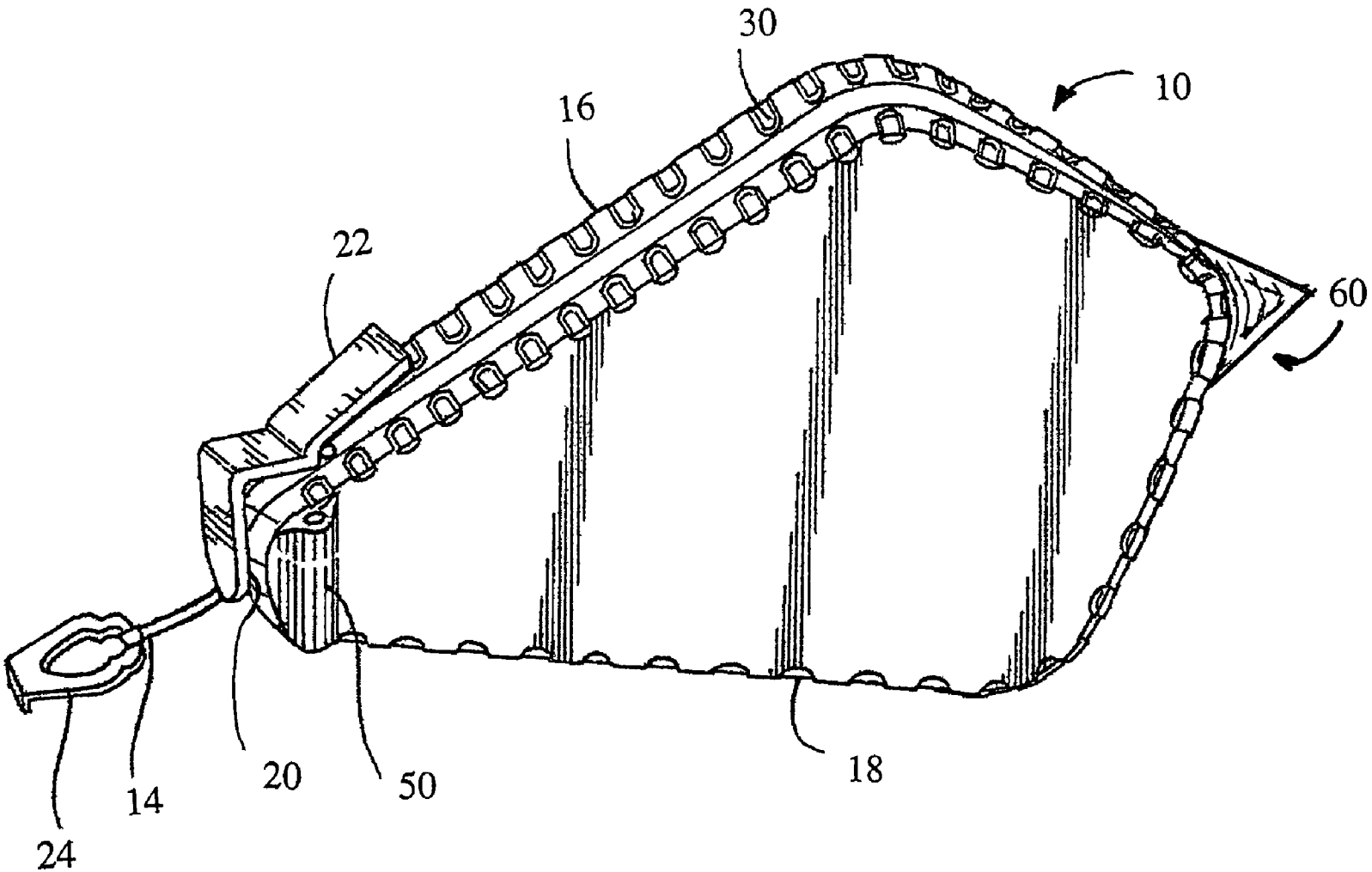
FIG. 1 is a perspective view of the automatically retracting chalk line dispenser.
Figure 2:
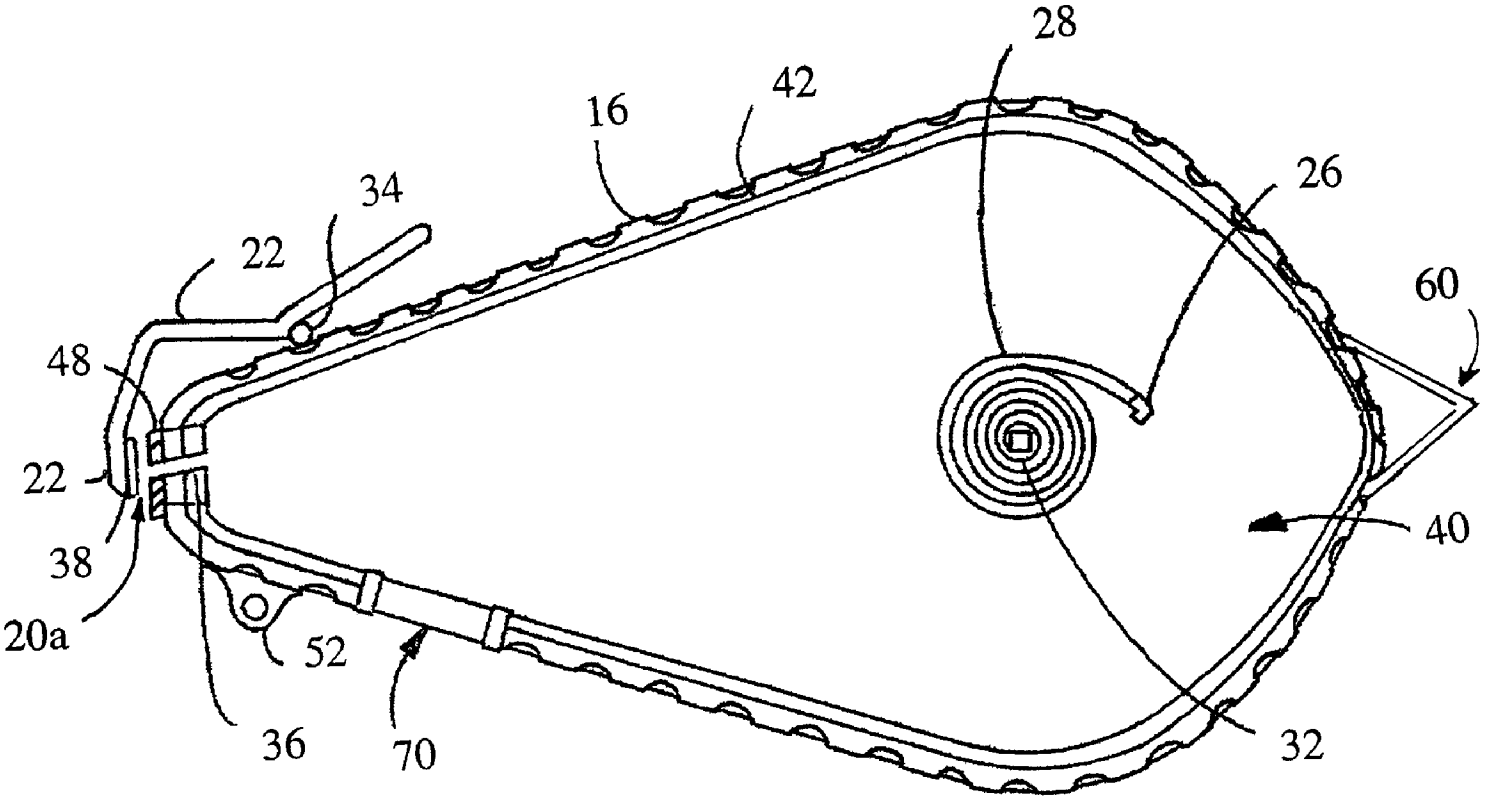
FIG. 2 is a side view of the first casing element.

Referring to the accompanying drawings in which like reference numbers indicate like elements, FIG. 1 illustrates an automatically retracting chalk line dispenser 10. The chalk line dispenser 10 includes a first casing element 16 and a second casing element 18. The first and second casing elements 16, 18 conveniently fit together forming a chalk reservoir 40 (as best seen in FIG. 2). The first and second casing elements 16, 18 may be made of plastic or metal. In the depicted embodiment, the first and second casing elements 16, 18 are made from mild steel and include a plurality of finger grooves 30 formed along each outer edge, such as by stamping. The chalk line dispenser 10 also includes an aperture 20. A chalk line 14 is threaded through the aperture 20. The chalk line 14 is generally wrapped onto a reel 12, which is mounted within the chalk reservoir 40. The chalk line 14 optionally includes a clip or hook 24. The clip 24 is used to attach the end of the string 14 to an object. The chalk line dispenser 10 also includes a thumb-lever 22. The thumb-lever 22 can be made from various materials but is made of metal, steel for example, in the depicted embodiment. The thumb-lever 22 pinches the chalk line 14 against the first and second casing elements 16, 18.

In the depicted embodiment, the chalk line dispenser 10 includes a pointer 60. The pointer 60 allows the chalk line dispenser 10 to also function as a plumb bob. Because the clip 24, the line 14, the pointer 60, and the center of gravity of the casing elements 16, 18 all fall along the same line, the pointer 60 will be pointed downwardly along a vertical line when the chalk line dispenser 10 is suspended by the clip 24.

The chalk line dispenser 10 also includes a first eyelet 50. The first eyelet 50 can be used to secure the casing elements 16, 18, and thereby the chalk line dispenser 10, to another object or article. For example, a penny nail may be inserted through the first eyelet 50 and nailed to a wooden floor to secure the casing elements 16, 18 to the wooden floor. While in the depicted embodiment the first eyelet 50 is shown as attached to the second casing element 18, the first eyelet could equally be attached to the first casing element 16, or both. The first eyelet 50 is operatively connected to the second casing element 18. In an alternative embodiment, the first eyelet 50 is formed as part of the second casing element 18. Additionally, the first eyelet 50 is proximate or near the aperture 20 in the depicted embodiment. However, those skilled in the art will understand that the first eyelet 50 could be located in other locations. In the embodiments where the casing elements are plastic, the first eyelet 50 is reinforced, such as by a metal insert.

FIG. 2 illustrates in greater detail the first casing element 16. The first casing element 16 includes a first cutout 20*a*. The cutout 20*a* forms one-half of the aperture 20. The aperture 20 is surrounded by a ring 48. The ring 48, such as a rubber washer or an o-ring, is provided to absorb shock when the chalk line 14 is rewound quickly. A hook and spring 34 is operatively connected, such as by welding, to the first casing element 16. The thumb-lever 22 is operatively engaged with the hook and spring 34. The hook and spring 34 mounts the thumb-lever 22 on the first casing element 16 and biases the thumb-lever 22 against the aperture 20. In the depicted embodiment, a rubber pad 38 is operatively connected to the thumb-lever 22. The rubber pad 38 may be omitted in some embodiments. The rubber pad 38 cushions the operation of the thumb-lever 22 and enhances the thumb-lever's braking action function.

The first casing element 16 also includes a coil spring 28 for automatically retracting the chalk line 14. One end of the coil spring 28 is operatively connected to a post 26. The post 26 is operatively connected to the first casing element 16. In an alternative embodiment, the post 26 is an integral component of the first casing element 16. The other end of the coil spring 28 is connected to a shaft 32. In the depicted embodiment, the shaft 32 is square-shaped to engage with the reel 12 having a square hub, however, other shapes maybe used so long as the shaft 32 is in driving connection with the reel 12. One-half of a chalk door opening 70 is shown in FIG. 2 along one side of the first casing element 16. In the depicted embodiment, a second eyelet 52 is operatively connected to the first casing element 16 and adjacent the chalk door opening 70. In an alternative embodiment, the second eyelet 52 is formed as part of the first casing element 16. The first casing element 16 further includes a groove 42 along its mating face.

Figure 3:
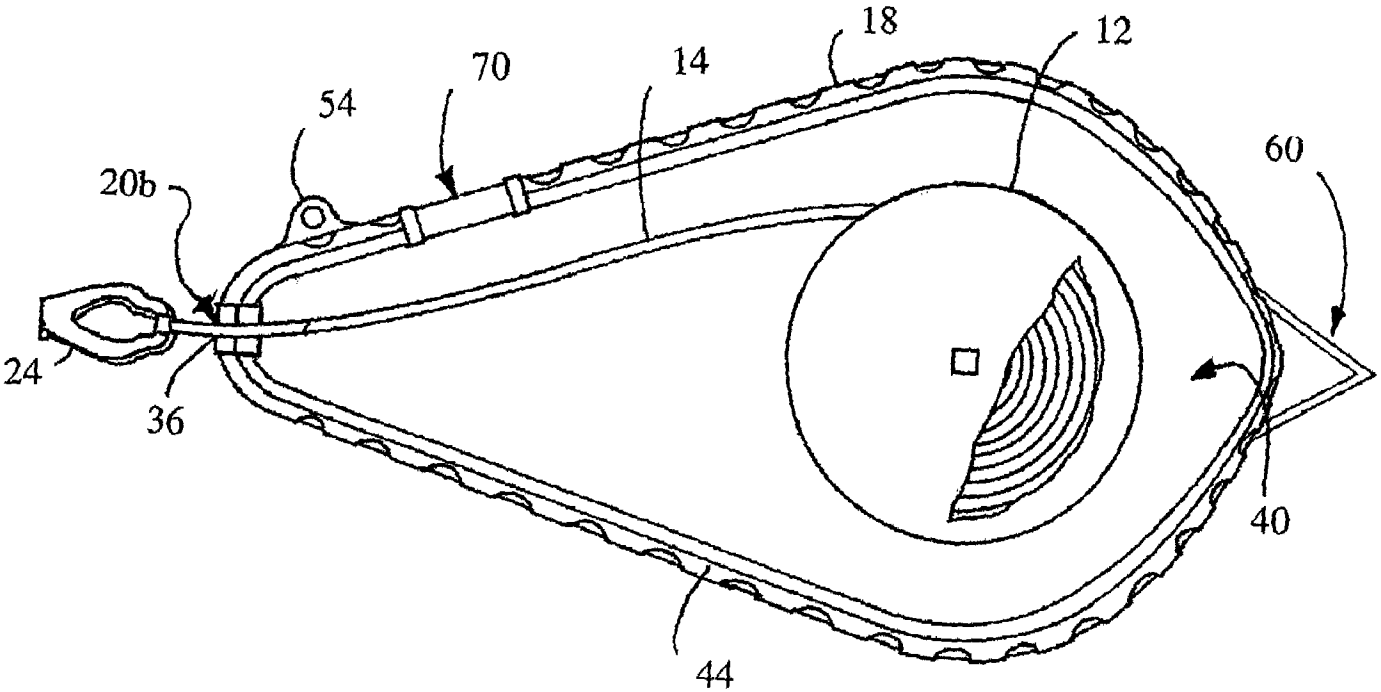
FIG. 3 is a side view of the second casing element.

The second casing element 18 is shown in FIG. 3. The second casing element 18 includes a second cutout 20*b*. The first and second cutouts 20*a*, 20*b* form the aperture 20. The second casing element 18 includes the reel 12 and the chalk line 14. As noted above, the chalk line 14 is generally wound around the reel 12. In some embodiments, the chalk line dispenser 10 includes a chalk filter 36 for removing excess chalk from the chalk line 14 as it is expelled. The second casing element 18 also includes a channel rib 44 along its mating face. The channel rib 44 is constructed and arranged to engage with the groove 42 thereby allowing the first and second casing elements 16, 18 to be snapped or pressed together. One-half of the chalk door opening 70 is shown in FIG. 3 along one side of the second casing element 18. In the depicted embodiment, a third eyelet 54 is operatively connected to the second casing element 18 and adjacent the chalk door opening 70. In an alternative embodiment, the third eyelet 54 is formed as part of the second casing element 18.

In the depicted embodiments, the second eyelet 52 and the third eyelet 54 are located near and are proximate to the aperture 20. However, those skilled in the art will understand that the second and third eyelets 52, 54 may be located in other locations.

Figure 4:
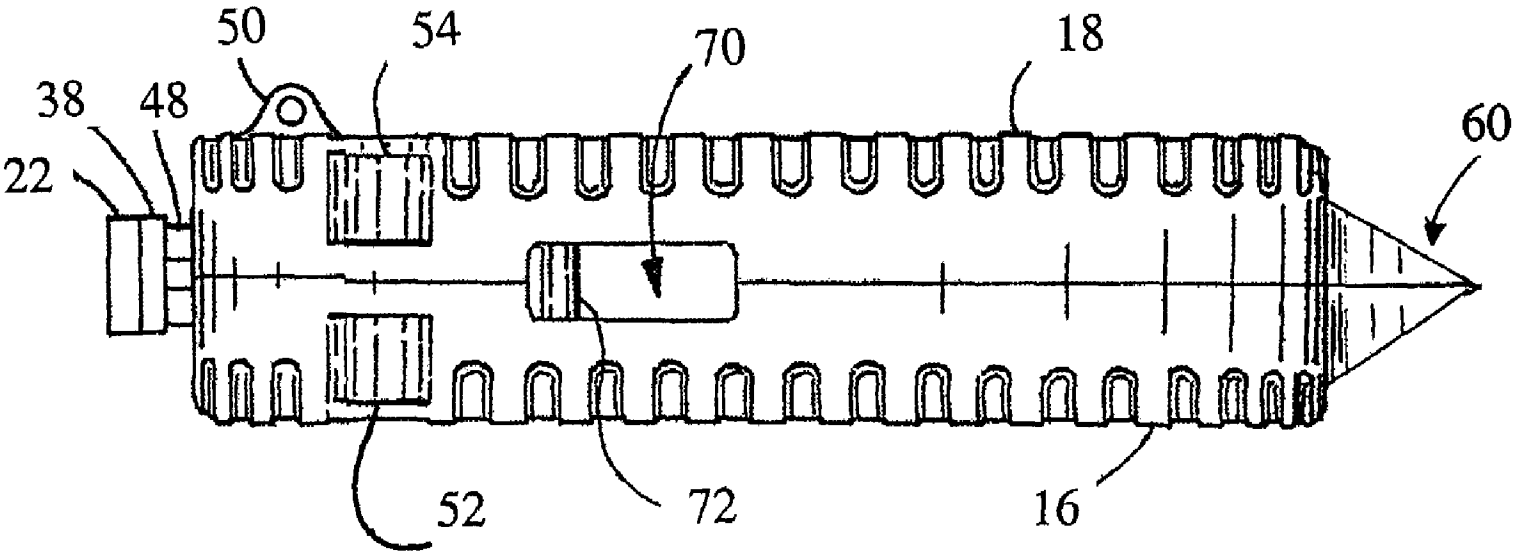
FIG. 4 is a bottom view of the automatically retracting chalk line dispenser.

FIG. 4 illustrates a bottom view of the chalk line dispenser 10. The chalk line dispenser 10 includes a sliding door 72 within the chalk door opening 70. In the depicted embodiment, the second eyelet 52 and the third eyelet 54 are coaxial. In the embodiments where the casing elements are plastic, the second and third eyelets 52, 54 are reinforced, such as by a metal insert.

Figure 5:
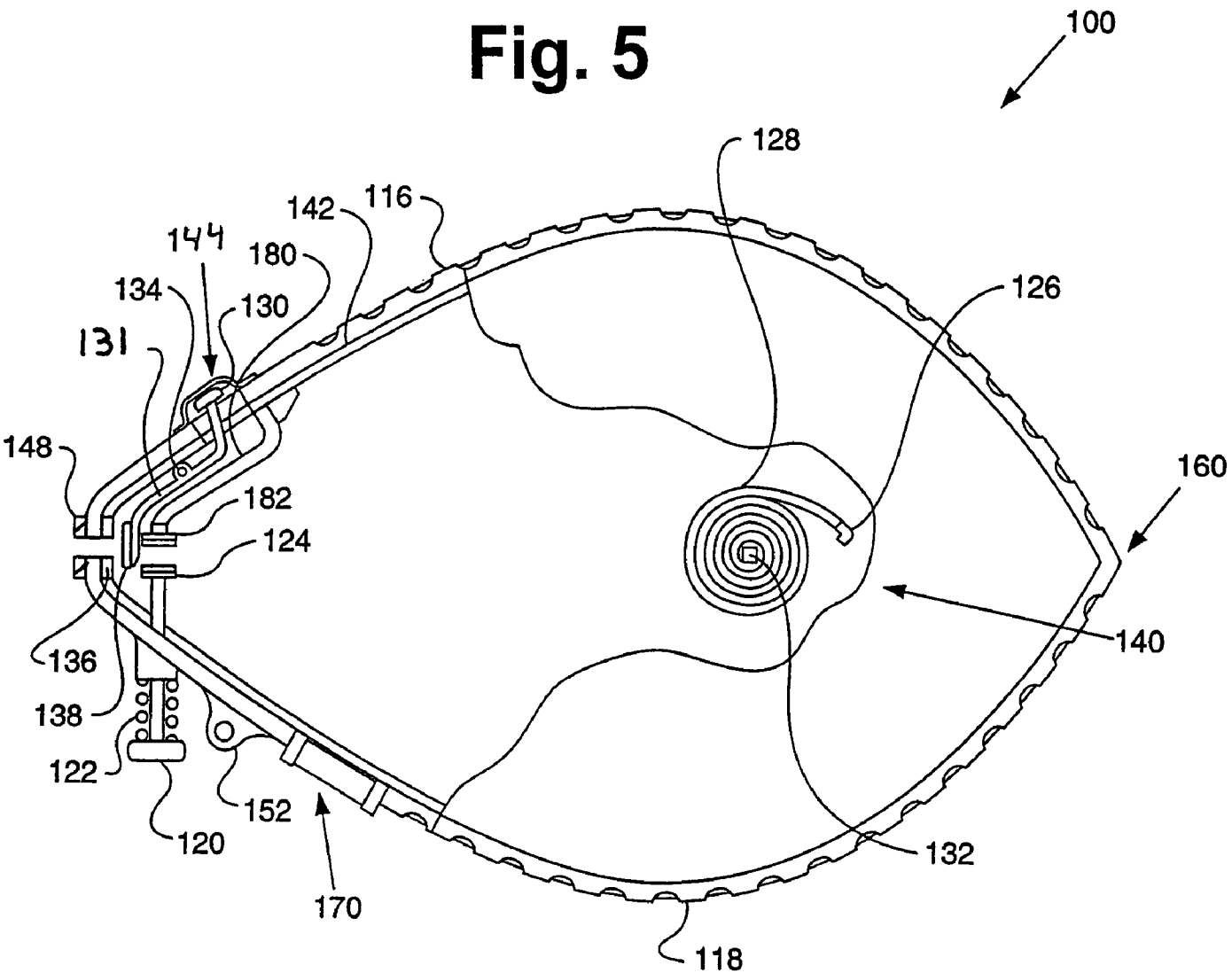
FIG. 5 is a side view of an alternative embodiment of the of the automatically retracting chalk line dispenser.

FIG. 5 illustrates an alternative embodiment of the automatically retracting chalk line dispenser, generally indicated by reference numeral 100. The chalk line dispenser 100 includes a first casing element 116, a second casing element 118, a chalk reservoir 140, a groove 142, a coil spring 128, a post 126, a shaft 132 for connection to a reel (not shown), a chalk door 170, an eyelet 152, a chalk filter 136, a ring 148, and a pointer 160. As seen in the depicted embodiment, the pointer 160 is an integral part of the first casing element 116 and the second casing element 118.

The automatically retracting chalk line dispenser 100 further includes a stop button 130. A user uses his or her thumb to depress the stop button 130 to hold the chalk line in place. The stop button 130 is operatively connected to a stop arm 131. In the depicted embodiment, the stop arm 131 is pivotably connected to the first casing element 116 and pivots about a pivot point 134. The stop arm 131 includes a stop pad 138 at its distal end. The stop pad 138 engages the chalk filter 136 to pinch the chalk line. In the depicted embodiment, an elastomeric cover 144 covers the stop button 130 to keep out dirt and unwanted elements.

The automatically retracting chalk line dispenser 100 further includes a stop button 130. A user uses his or her thumb to depress the stop button 130 to hold the chalk line in place. The stop button 130 is operatively connected to a stop arm 131. In the depicted embodiment, the stop arm 131 is pivotably connected to the first casing element 116 and pivots about a pivot point 134. The stop arm 131 includes a stop pad 138 at its distal end. The stop pad 138 engages the chalk filter 136 to pinch the chalk line. In the depicted embodiment, an elastomeric cover 132 covers the stop button 130 to keep out dirt and unwanted elements.

Referring once again to FIGS. 1–4, in operation, the clip 24 is attached to an object, such as a deck board of a deck. The thumb-lever 22 is fully depressed and the chalk line 14 is expelled such that the chalk line is drawn tight between the deck board and the chalk line dispenser 10. As the chalk line 14 is expelled off the reel 12, the reel 12 and shaft 32 rotate together causing the coil spring 28 to be wound. When the desired length of chalk line 14 has been expelled, the thumb-lever 22 is released. The released thumb-lever 22 pinches the chalk line 14 against the first and second casing elements, effectively braking the chalk line 14. The chalk line 14 is "snapped" against the deck thereby producing a straight line of chalk dust on the deck. The thumb-lever 22 is partially depressed, allowing the coil spring 28 to unwind and thereby cause the chalk line 14 to be wrapped on the reel 12. When the thumb-lever 22 is only partially depressed, the rate of chalk line retraction is controlled by friction between the chalk line 14 and the first and second casing elements 16, 18. When the rubber pad 38 is attached to the thumb-lever 22, there is also friction between the rubber pad 38 and the chalk line 14. Thus, the rubber pad 38 also contributes to the braking of the chalk line 14 when it is expelled or retracted. The greater the amount of depression of the thumb-lever 22, the less friction is encountered and, thus, the greater the rate of chalk line retraction. When the thumb-lever 22 is fully depressed, the chalk line 14 is retracted at full speed.

The chalk line dispenser 10 may be secured using one of the eyelets, such as the first eyelet 50, to an article, a wooden floor for example. The chalk line dispenser 10 must be positioned such that the eyelet desired to secure the chalk dispenser is substantially perpendicular to the floor. After the chalk line dispenser 10 is positioned, a spike, such as a penny nail, is placed through the eyelet. The spike is then forced into the article, thereby securing the chalk line dispenser 10 to the article. Once the chalk line dispenser 10 is secured, a desired amount of the chalk line 14 is expelled. Optionally, the free end of the chalk line 14 may be fixed through the use of the clip 24. If the chalk line 14 is secured on one end by the clip 24 and secured on the other end through the use of the eyelet, one hand operation is possible. The chalk line 14 is drawn tight and then snapped, thereby producing a straight chalk line.

To refill the chalk line dispenser 10 with chalk, the chalk door 72 is slid open. Chalk is poured into the chalk door opening 70 until the chalk reservoir 40 is filled with a desired amount of chalk. The chalk door 70 is then slid closed.

A method of assembling the chalk dispenser includes the steps of: providing a first casing element having a groove, a post and at least one eyelet; providing a second casing element having a rib; attaching a hook and spring to said first casing element; attaching a coil spring to said post; rotatably mounting a reel to said second casing element; wrapping a chalk line generally about said reel; interconnecting said coil spring and said reel; pressing together said first casing element and said second casing element such that said rib fits within said groove; and disposing a thumb-lever on said first or said second casing element such that said thumb-lever may selectively brake retraction of said chalk line.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while the automatic chalk dispenser is depicted as including a pointer, the pointer may be omitted in some embodiments. Thus, the breadth and scope of the present invention should not be limited by any of the above-described exemplary embodiments, but should be defined only in accordance with the following claims appended hereto and their equivalents.

What is claimed is:

1. A chalk dispenser comprising:

a. a first casing element, said first casing element having a first cutout and a post;

b. a second casing element opposite of said first casing element, said second casing element having a second cutout;

c. said first casing element and said second casing element being adapted to fit together to form a chalk reservoir and said first cutout and said second cutout forming an aperture;

d. a coil spring having a first end and a second end, said coil spring mounted to said first casing element and said first end operatively connected to said post;

e. a reel rotatably mounted to said second casing element;

f. a driving connection operatively connecting said second end of said coil spring and said reel;

g. a chalk line generally wrapped about said reel;

h. at least a portion of said chalk line being located within said aperture; and j. a thumb-lever mounted to at least one of said casing elements, said thumb-lever adapted to pinch said chalk line against at least one of said casing elements at said aperture.

2. The chalk dispenser according to claim 1, wherein said first casing element and said second casing element are plastic.

3. The chalk dispenser according to claim 1, wherein said first casing element and said second casing element are metal.

4. The chalk dispenser according to claim 1, wherein said first casing element and said second casing element each include finger grooves.

5. The chalk dispenser according to claim 1, wherein said chalk reservoir includes a pointer.

6. The chalk dispenser according to claim 1, further comprising a ring operatively mounted to said aperture.

7. The chalk dispenser according to claim 1, further comprising a clip attached to a distal end of said chalk line.

8. The chalk dispenser according to claim 1, further comprising a hook and spring arrangement operatively connected to said thumb-lever.

9. The chalk dispenser according to claim 1, further comprising a rubber pad operatively connected to an end of said thumb-lever.

10. The chalk dispenser according to claim 1, wherein said driving connection is a square shaft.

11. The chalk dispenser according to claim 1, wherein said second casing element has a rib and said first casing element has a groove along its peripheral edge adapted to receive said rib.

12. The chalk dispenser according to claim 1, further comprising a chalk filter.

13. The chalk dispenser according to claim 1, further comprising a sliding chalk door.

14. The chalk dispenser according to claim 1, further comprising a screw tensioner operatively connected to at least one of said casing elements.

15. The chalk dispenser according to claim 1, further comprising at least one eyelet operatively connected to at least one of said casing elements.

16. The chalk dispenser according to claim 15, wherein said at least one eyelet is an integral component of said first casing element.

17. The chalk dispenser according to claim 15, wherein said at least one eyelet is an integral component of said second casing element.

18. The chalk dispenser according to claim 15, wherein said at least one eyelet is proximate to said aperture.

19. The chalk dispenser according to claim 15, further comprising at least one other eyelet operatively connected to at least one of said casing elements.

20. The chalk dispenser according to claim 19, wherein said at least one eyelet and said at least one other eyelet are coaxial.

21. The chalk dispenser according to claim 19, wherein said at least one eyelet and said at least one other eyelet are perpendicular to one another.

22. The chalk dispenser according to claim 19, wherein said at least one eyelet and said at least one other eyelet are reinforced.

23. A chalk dispenser comprising:

a. a first casing element, said first casing element having a first cutout and a post;

b. a second casing element opposite of said first casing element, said second casing element having a second cutout;

c. said first casing element and said second casing element being adapted to fit together to form a chalk reservoir and said first cutout and said second cutout forming an aperture;

d. a coil spring having a first end and a second end, said coil spring mounted to said first casing element and said first end operatively connected to said post;

e. a reel rotatably mounted to said second casing element;

f. a driving connection operatively connecting said second end of said coil spring and said reel;

g. a chalk line generally wrapped about said reel;

h. at least a portion of said chalk line being located within said aperture; and j. a chalk line brake disposed to engage said chalk line in and at least one of said casing elements at said aperture.

24. The chalk dispenser according to claim 23, wherein said chalk line brake comprises a stop button.

25. The chalk dispenser according to claim 23, wherein said chalk line brake comprises a thumb-lever.

26. The chalk dispenser according to claim 25, further comprising a screw tensioner operatively connected to at least one of said casing elements.

27. The chalk dispenser according to claim 23, further comprising at least one eyelet operatively connected to at least one of said casing elements.

28. The chalk dispenser according to claim 27, further comprising at least one other eyelet operatively connected to at least one of said casing elements.

29. The chalk dispenser according to claim 28, wherein said at least one eyelet and said at least one other eyelet are coaxial.

30. The chalk dispenser according to claim 28, wherein said at least one eyelet and said at least one other eyelet are perpendicular to one another.

31. The chalk dispenser according to claim 28, wherein said at least one eyelet and said at least one other eyelet are reinforced.

32. A chalk dispenser comprising:

a. a first casing element, said first casing element having a first cutout and a post;

b. a second casing element opposite of said first casing element, said second casing element having a second cutout;

c. said first casing element and said second casing element being adapted to fit together to form a chalk reservoir and said first cutout and said second cutout forming an aperture;

d. a coil spring having a first end and a second end, said coil spring mounted to said first casing element and said first end operatively connected to said post;

e. a reel rotatably mounted to said second casing element;

f. a driving connection operatively connecting said second end of said coil spring and said reel;

g. a chalk line generally wrapped about said reel;

h. at least a portion of said chalk line being located within said aperture; and j. means for braking and clutching said chalk line against at least one of said casing elements about said aperture.

33. A method of assembling a chalk dispenser, the method comprising the steps of:

a. providing a first casing element having a groove, a post and at least one eyelet;

b. providing a second casing element having a rib;

c. attaching a hook and spring to said first casing element;

d. attaching a coil spring to said post;

e. rotatably mounting a reel to said second casing element;

f. wrapping a chalk line generally about said reel;

g. interconnecting said coil spring and said reel;

h. pressing together said first casing element and said second casing element such that said rib fits within said groove; and disposing a thumb-lever on said first or said second casing element such that said thumb-lever may selectively brake retraction of said chalk line by engagement of said thumb-lever with at least one of said casing elements about said aperture.

* * * * *